US011744278B2

(12) United States Patent
Ademe et al.

(10) Patent No.: US 11,744,278 B2
(45) Date of Patent: Sep. 5, 2023

(54) APPARATUS AND METHOD FOR APPLYING AN ADDITIVE TO A TOBACCO ROD OF A SMOKING ARTICLE

(71) Applicant: R. J. REYNOLDS TOBACCO COMPANY, Winston-Salem, NC (US)

(72) Inventors: Balager Ademe, Winston Salem, NC (US); Richard L. Sizemore, Clemmons, NC (US)

(73) Assignee: R.J. REYNOLDS TOBACCO COMPANY, Winston-Salem, NC (US)

( * ) Notice: Subject to any disclaimer, the term of this patent is extended or adjusted under 35 U.S.C. 154(b) by 273 days.

(21) Appl. No.: 17/175,015

(22) Filed: Feb. 12, 2021

(65) Prior Publication Data

US 2022/0256911 A1 Aug. 18, 2022

(51) Int. Cl.
*A24B 15/30* (2006.01)
*A24C 5/18* (2006.01)

(52) U.S. Cl.
CPC ..... *A24C 5/1892* (2013.01); *A24B 15/302* (2013.01); *A24C 5/1807* (2013.01)

(58) Field of Classification Search
CPC ..... A24C 5/1807; A24C 5/1892
See application file for complete search history.

(56) References Cited

U.S. PATENT DOCUMENTS 2,617,426 A * 11/1952 Patterson ..... A24C 5/1807 131/287
4,186,754 A 2/1980 Labbe
4,409,995 A * 10/1983 Nichols ..... A24B 15/283 131/288
4,474,190 A 10/1984 Brand
4,619,276 A 10/1986 Albertson et al.
4,913,166 A 4/1990 Christensson et al.
4,979,521 A 12/1990 Davis et al.
5,052,412 A 10/1991 Green et al.
5,163,452 A 11/1992 Marritt et al.
7,770,585 B2 8/2010 Fowles
8,157,918 B2 4/2012 Becker et al.
2010/0224202 A1 9/2010 McLellan

FOREIGN PATENT DOCUMENTS

GB 2 078 488 1/1982

* cited by examiner

*Primary Examiner* — Eric Yaary
(74) *Attorney, Agent, or Firm* — Womble Bond Dickinson (US) LLP

(57) ABSTRACT

An apparatus arranged to form a continuous tobacco rod of a smoking article, comprises a conveyor conveying a tobacco material stream in a conveyance direction, and a wrapping material supply arrangement advancing a web of wrapping material in the conveyance direction adjacent to the tobacco material stream. A constriction member receives the tobacco material stream at an inlet end and reduces a cross-sectional area of the tobacco material stream. The reduced-area tobacco material stream exits the constriction member at an exit end, and the wrapping material web wraps about the reduced-area tobacco material stream exiting the exit end. An additive source supplies an additive material to the reduced-area tobacco material stream through a dispensing port disposed about the exit end of the constriction member, prior to the reduced-area tobacco material stream being wrapped by the wrapping material web to form the continuous tobacco rod.

16 Claims, 4 Drawing Sheets

Figure 1:
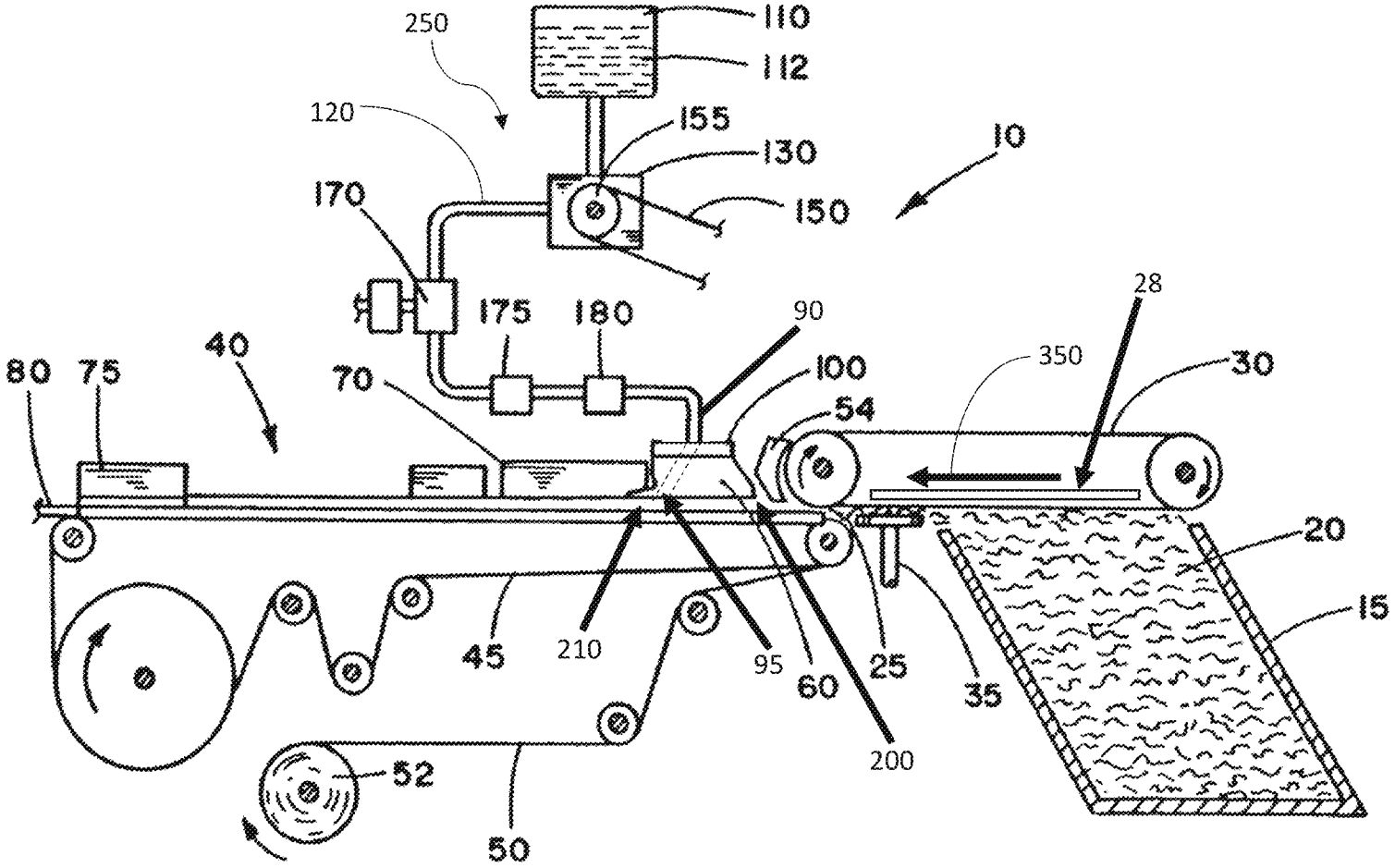

APPARATUS AND METHOD FOR APPLYING AN ADDITIVE TO A TOBACCO ROD OF A SMOKING ARTICLE

BACKGROUND

Field of the Disclosure

The present disclosure relates to the formation of tobacco rods for smoking articles and, more particularly, to an apparatus, system, and method for applying an additive to the tobacco in a tobacco rod of a smoking article.

Description of Related Art

An example machine used to produce the tobacco rod portion of conventional cigarettes includes a smokable fill material (e.g., tobacco) source, such as chimney, through which tobacco filler or other smokable fill material is established in a continuous stream on an endless, porous, formable conveyor belt. As such, a source of tobacco filler or generally a tobacco material is established and maintained in order that a continuous stream of tobacco filler is supplied. The stream of tobacco filler is conveyed by the belt past a trimming or equalizing device in order to supply a uniform stream of the tobacco filler. The tobacco filler is maintained in contact with the lower section of the belt by a vacuum or suction source.

In a garniture section of the cigarette making machine, an endless formable garniture conveyor belt advances a longitudinally-continuous web of a wrapping material, such as a cigarette paper, for example, from a bobbin. One end of the conveyor belt is positioned adjacent to and below the exit end of the porous belt in order that the continuous tobacco stream is deposited on or otherwise engaged with a first surface of the longitudinally-continuous web of the wrapping material. Generally, the web has laterally-opposed first and second edge portions extending along the longitudinally-continuous web, wherein the web also includes a second surface opposing the first surface.

A short tongue located above belt in the garniture section is configured to begin to constrict the stream as the belt begins to form the filler stream and wrapper web into a continuous rod. A subsequent downstream tongue located above the belt in the garniture section constricts the stream as the belt forms the filler stream and wrapper web into the continuous rod. The tongue extends to a point or exit end where the wrapping material is secured around the filler stream. That is, the tongue is configured to longitudinally overlap the first and second edge portions of the wrapper web such that the first surface about the first edge portion extends over the second surface about the second edge portion. In this manner, the smokable filler material is contained within the longitudinally-continuous web, as the wrapping material is secured around the filler stream.

The tongue and the belt carrying the wrapper web define a passage which progressively decreases in cross-section in the direction of movement of the filler stream such that the filler stream progressively assumes a substantially circular cross-section toward the exit end of the tongue, so as to form the filler stream into substantially the desired (e.g., circular) cross-section of the ultimate finished cigarette rod. A formed tobacco rod exits the tongue, and an adhesive material from a source is applied using adhesive application device to an exposed length of the web associated with the lap region or overlap between the opposed edge portions of the wrapper web.

In the formation of conventional cigarettes, smokers may prefer that an additive or flavorant, such as menthol, be available to flavor the smoke drawn from the ignited tobacco material. Accordingly, the menthol may be applied to the filter portion of the cigarette, or to the tobacco within the tobacco rod portion of the cigarette during formation thereof. In formation of the tobacco rod portion of the cigarette, menthol has been applied to the tobacco material 1) in a bulk drum prior to the tobacco material entering the chimney or 2) as the tobacco material is transported by the conveyor to the garniture region. In either instance, however, there is required an approximately 25% overage dose of menthol in order to achieve sufficiently even coverage of the tobacco material that is eventually incorporated into the formed tobacco rod, or to otherwise account for the loss of menthol during the process of applying the menthol to the tobacco material.

Thus, there exists a need for an apparatus, system, and method for uniform application of an additive or flavorant to the tobacco material in a tobacco rod formation process.

SUMMARY

The above and other needs are met by aspects of the present disclosure which, in one aspects, provides an apparatus arranged to form a continuous tobacco rod of a smoking article. Such an apparatus comprises a conveyor arranged to convey a tobacco material stream in a conveyance direction. A wrapping material supply arrangement is arranged to advance a web of wrapping material in the conveyance direction adjacent to the tobacco material stream. A constriction member is arranged to receive the tobacco material stream at an inlet end and to reduce a cross-sectional area of the tobacco material stream, with the reduced-area tobacco material stream exiting the constriction member at an exit end of the constriction member. The wrapping material web wraps about the reduced-area tobacco material stream exiting the exit end. An additive source is arranged to supply an additive material to the reduced-area tobacco material stream through a dispensing port disposed about the exit end of the constriction member prior to the reduced-area tobacco material stream being wrapped by the wrapping material web to form the continuous tobacco rod.

Another aspect of the present disclosure provides an additive material dispensing system for an apparatus arranged to form a continuous tobacco rod of a smoking article, wherein the apparatus includes a conveyor arranged to convey a tobacco material stream in a conveyance direction and a wrapping material supply arrangement arranged to advance a web of wrapping material in the conveyance direction adjacent to the tobacco material stream. Such an additive material dispensing system comprises a constriction member arranged to receive the tobacco material stream at an inlet end and to reduce a cross-sectional area of the tobacco material stream, with the reduced-area tobacco material stream exiting the constriction member at an exit end. The constriction member is further arranged such that the wrapping material web wraps about the reduced-area tobacco material stream exiting the exit end. An additive source is arranged to supply an additive material to the reduced-area tobacco material stream through a dispensing port disposed about the exit end of the constriction member, prior to the reduced-area tobacco material stream being wrapped by the wrapping material web to form the continuous tobacco rod.

Still another aspect of the present disclosure provides a method of forming a continuous tobacco rod of a smoking article. Such a method comprises conveying a tobacco material seam on a conveyor in a conveyance direction, and advancing a web of wrapping material associated with a wrapping material supply arrangement in the conveyance direction adjacent to the tobacco material stream. The tobacco material stream is received at an inlet end of a constriction member and a cross-sectional area of the tobacco material stream is reduced by the constriction member. The reduced-area tobacco material stream exits the constriction member at an exit end. The wrapping material web wraps about the reduced-area tobacco material stream exiting the exit end of the constriction member. An additive material is supplied from an additive source to the reduced-area tobacco material stream through a dispensing port disposed about the exit end of the constriction member prior to wrapping the reduced-area tobacco material stream with the wrapping material web to form the continuous tobacco rod.

Yet another aspect of the present disclosure provides an apparatus arranged to form a continuous tobacco rod of a smoking article. Such an apparatus comprises a conveyor arranged to convey a tobacco material stream in a conveyance direction and a wrapping material supply arrangement arranged to advance a web of wrapping material in the conveyance direction adjacent to the tobacco material stream. A tongue is arranged to receive the tobacco material stream at an inlet end and to reduce a cross-sectional area of the tobacco material stream. The reduced-area tobacco material stream exits the tongue at an exit end, and the wrapping material web is arranged to wrap about the reduced-area tobacco material stream exiting the exit end. The tongue also has a first heating element arranged to communicate heat to the exit end of the constriction member. An additive source is arranged to transform a crystalline additive into a liquid additive, and to supply the liquid additive to the reduced-area tobacco material stream through a dispensing port disposed about the heated exit end of the tongue, prior to the reduced-area tobacco material stream being wrapped by the wrapping material web to form the continuous tobacco rod.

The present disclosure thus includes, without limitation, the following example embodiments:

Example Embodiment 1: An apparatus arranged to form a continuous tobacco rod of a smoking article, comprising a conveyor arranged to convey a tobacco material stream in a conveyance direction; a wrapping material supply arrangement arranged to advance a web of wrapping material in the conveyance direction adjacent to the tobacco material stream; a constriction member arranged to receive the tobacco material stream at an inlet end and to reduce a cross-sectional area of the tobacco material stream, the reduced-area tobacco material stream exiting the constriction member at an exit end, and the wrapping material web being arranged to wrap about the reduced-area tobacco material stream exiting the exit end; and an additive source arranged to supply an additive material to the reduced-area tobacco material stream through a dispensing port disposed about the exit end of the constriction member prior to the reduced-area tobacco material stream being wrapped by the wrapping material web to form the continuous tobacco rod.

Example Embodiment 2: The apparatus of any preceding example embodiment, or combinations thereof, comprising a first heating element arranged with respect to the constriction member to communicate heat to the exit end of the constriction member.

Example Embodiment 3: The apparatus of any preceding example embodiment, or combinations thereof, wherein the additive source is a menthol source and the additive material is menthol.

Example Embodiment 4: The apparatus of any preceding example embodiment, or combinations thereof, wherein the additive source is in fluid communication with the dispensing port via a conduit engaged therebetween, and wherein the apparatus further comprises a second heating element arranged to communicate heat to the additive source or to the conduit.

Example Embodiment 5: The apparatus of any preceding example embodiment, or combinations thereof, comprising a pump in fluid communication with the additive source or the conduit, and arranged to pump the additive material through the conduit to the dispensing port.

Example Embodiment 6: An apparatus material dispensing system for an apparatus arranged to form a continuous tobacco rod of a smoking article, the apparatus including a conveyor arranged to convey a tobacco material stream in a conveyance direction and a wrapping material supply arrangement arranged to advance a web of wrapping material in the conveyance direction adjacent to the tobacco material stream, the additive material dispensing system comprising a constriction member arranged to receive the tobacco material stream at an inlet end and to reduce a cross-sectional area of the tobacco material stream, the reduced-area tobacco material stream exiting the constriction member at an exit end, and the constriction member being further arranged such that the wrapping material web wraps about the reduced-area tobacco material stream exiting the exit end; and an additive source arranged to supply an additive material to the reduced-area tobacco material stream through a dispensing port disposed about the exit end of the constriction member, prior to the reduced-area tobacco material stream being wrapped by the wrapping material web to form the continuous tobacco rod.

Example Embodiment 7: The apparatus of any preceding example embodiment, or combinations thereof, comprising a first heating element arranged with respect to the constriction member to communicate heat to the exit end of the constriction member.

Example Embodiment 8: The apparatus of any preceding example embodiment, or combinations thereof, wherein the additive source is a menthol source and the additive material is menthol.

Example Embodiment 9: The apparatus of any preceding example embodiment, or combinations thereof, wherein the additive source is in fluid communication with the dispensing port via a conduit engaged therebetween, and wherein the system further comprises a second heating element arranged to communicate heat to the additive source or to the conduit.

Example Embodiment 10: The apparatus of any preceding example embodiment, or combinations thereof, comprising a pump in fluid communication with the additive source or the conduit, and arranged to pump the additive material through the conduit to the dispensing port.

Example Embodiment 11: A method of forming a tobacco rod of a continuous smoking article, comprising conveying a tobacco material stream on a conveyor in a conveyance direction; advancing a web of wrapping material associated with a wrapping material supply arrangement in the conveyance direction adjacent to the tobacco material stream; receiving the tobacco material stream at an inlet end of a constriction member and reducing a cross-sectional area of the tobacco material stream, the reduced-area tobacco material stream exiting the constriction member at an exit end; wrapping the wrapping material web about the reduced-area tobacco material stream exiting the exit end of the constriction member; and supplying an additive material from an additive source to the reduced-area tobacco material stream through a dispensing port disposed about the exit end of the constriction member prior to wrapping the reduced-area tobacco material stream with the wrapping material web to form the continuous tobacco rod.

Example Embodiment 12: The method of any preceding example embodiment, or combinations thereof, comprising communicating heat from a first heating element, arranged with respect to the constriction member, to the exit end of the constriction member.

Example Embodiment 13: The method of any preceding example embodiment, or combinations thereof, wherein supplying the additive material from the additive source to the reduced-area tobacco material stream through the dispensing port comprises supplying menthol from a menthol source to the reduced-area tobacco material stream through the dispensing port.

Example Embodiment 14: The method of any preceding example embodiment, or combinations thereof, wherein the additive source is in fluid communication with the dispensing port via a conduit engaged therebetween, and wherein the method further comprises communicating heat from a second heating element to the additive source or to the conduit.

Example Embodiment 15: The method of any preceding example embodiment, or combinations thereof, comprising pumping the additive material through the conduit and to the dispensing port with a pump in fluid communication with the additive source or the conduit.

Example Embodiment 16: An apparatus arranged to form a continuous tobacco rod of a smoking article, comprising a conveyor arranged to convey a tobacco material stream in a conveyance direction; a wrapping material supply arrangement arranged to advance a web of wrapping material in the conveyance direction adjacent to the tobacco material stream; a tongue arranged to receive the tobacco material stream at an inlet end and to reduce a cross-sectional area of the tobacco material stream, the reduced-area tobacco material stream exiting the tongue at an exit end, and the wrapping material web being arranged to wrap about the reduced-area tobacco material stream exiting the exit end, the tongue having a first heating element arranged to communicate heat to the exit end of the constriction member; and an additive source arranged to transform a crystalline additive into a liquid additive and to supply the liquid additive to the reduced-area tobacco material stream through a dispensing port, disposed about the heated exit end of the tongue prior to the reduced-area tobacco material stream being wrapped by the wrapping material web to form the continuous tobacco rod.

Example Embodiment 17: The apparatus of any preceding example embodiment, or combinations thereof, wherein the additive source is a menthol source and the crystalline additive is menthol.

Example Embodiment 18: The apparatus of any preceding example embodiment, or combinations thereof, wherein the additive source is in fluid communication with the dispensing port via a conduit engaged therebetween, and wherein the apparatus further comprises a second heating element arranged to communicate heat to the additive source or to the conduit.

Example Embodiment 19: The apparatus of any preceding example embodiment, or combinations thereof, comprising a pump in fluid communication with the additive source or the conduit, and arranged to pump the additive material through the conduit to the dispensing port.

These and other features, aspects, and advantages of the present disclosure will be apparent from a reading of the following detailed description together with the accompanying drawings, which are briefly described below. The present disclosure includes any combination of two, three, four, or more features or elements set forth in this disclosure, regardless of whether such features or elements are expressly combined or otherwise recited in a specific embodiment description herein. This disclosure is intended to be read holistically such that any separable features or elements of the disclosure, in any of its aspects and embodiments, should be viewed as intended, namely to be combinable, unless the context of the disclosure clearly dictates otherwise.

It will be appreciated that the summary herein is provided merely for purposes of summarizing some example aspects so as to provide a basic understanding of the disclosure. As such, it will be appreciated that the above described example aspects are merely examples and should not be construed to narrow the scope or spirit of the disclosure in any way. It will be appreciated that the scope of the disclosure encompasses many potential aspects, some of which will be further described below, in addition to those herein summarized. Further, other aspects and advantages of such aspects disclosed herein will become apparent from the following detailed description taken in conjunction with the accompanying drawings which illustrate, by way of example, the principles of the described aspects.

BRIEF DESCRIPTION OF THE SEVERAL VIEWS OF THE DRAWING(S)

Figure 2:
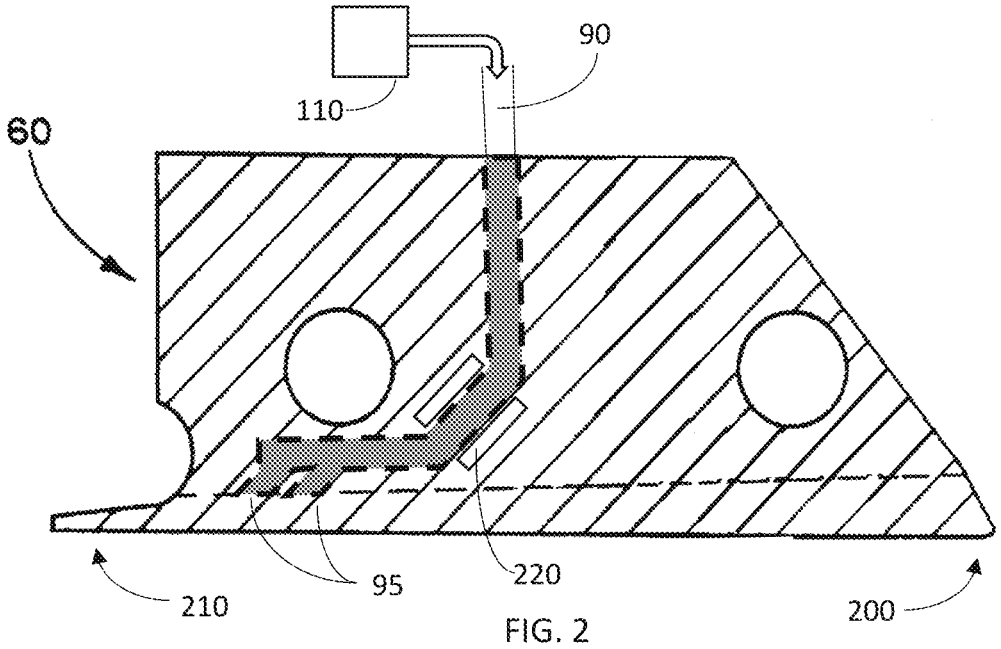
Figure 3:
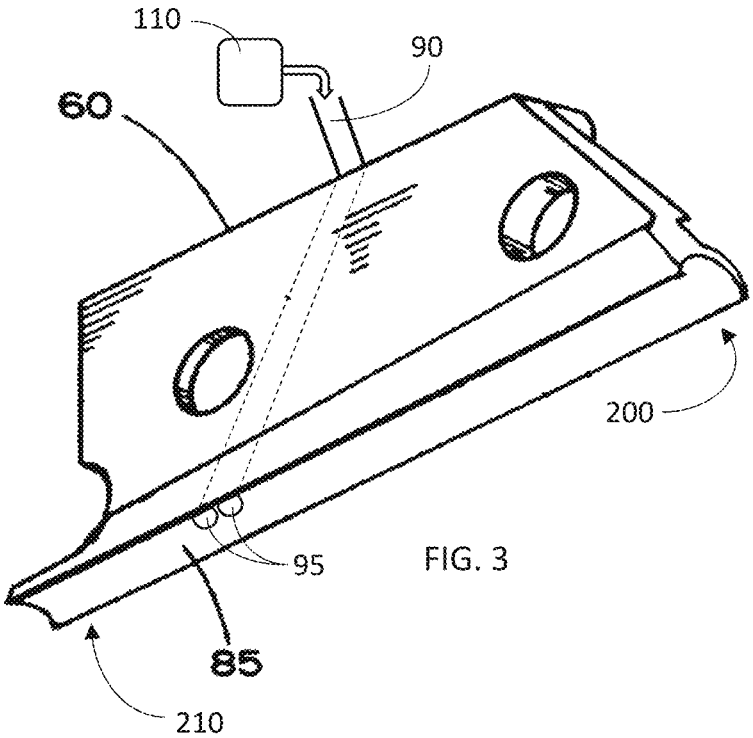
Figure 4:
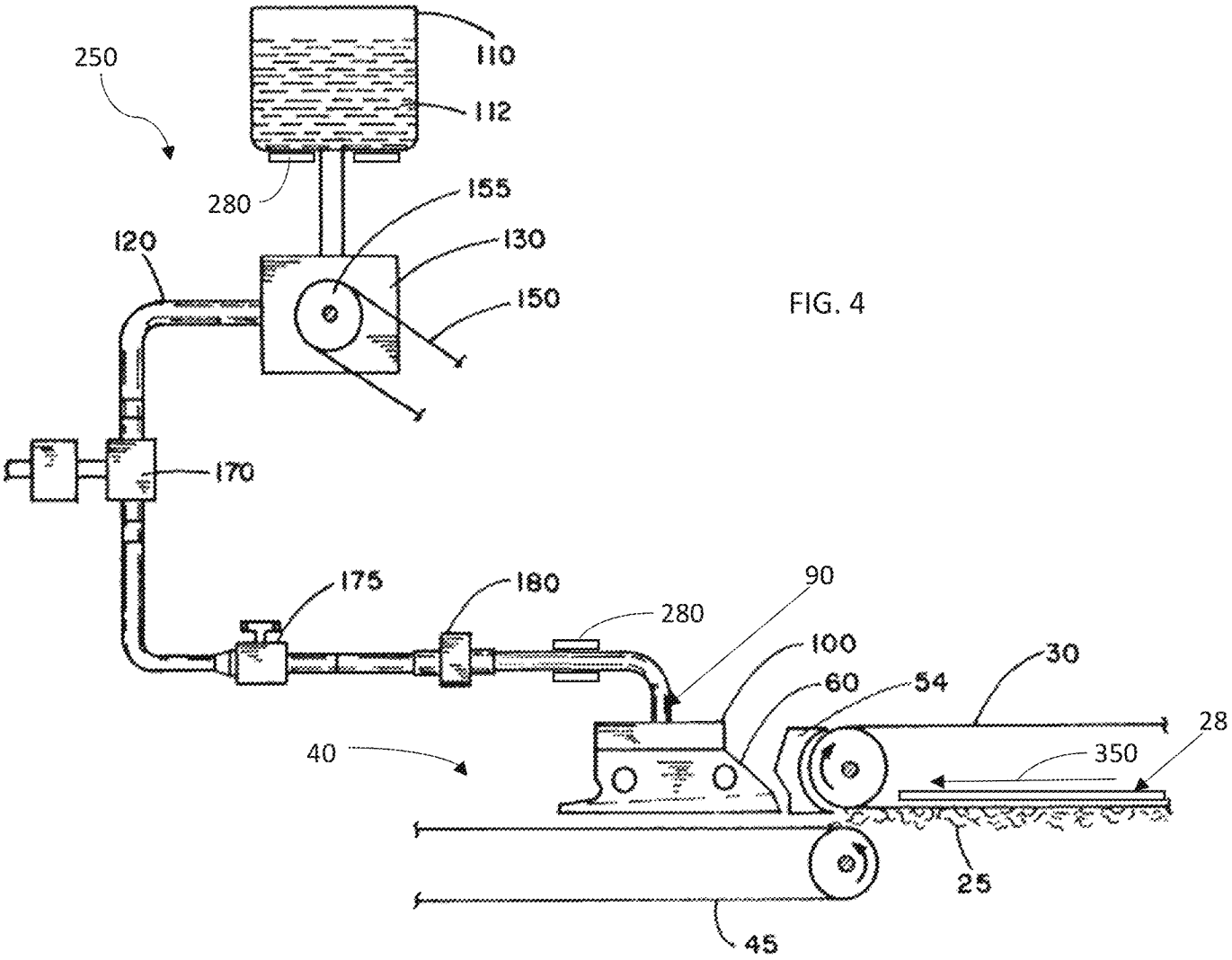
Figure 5:
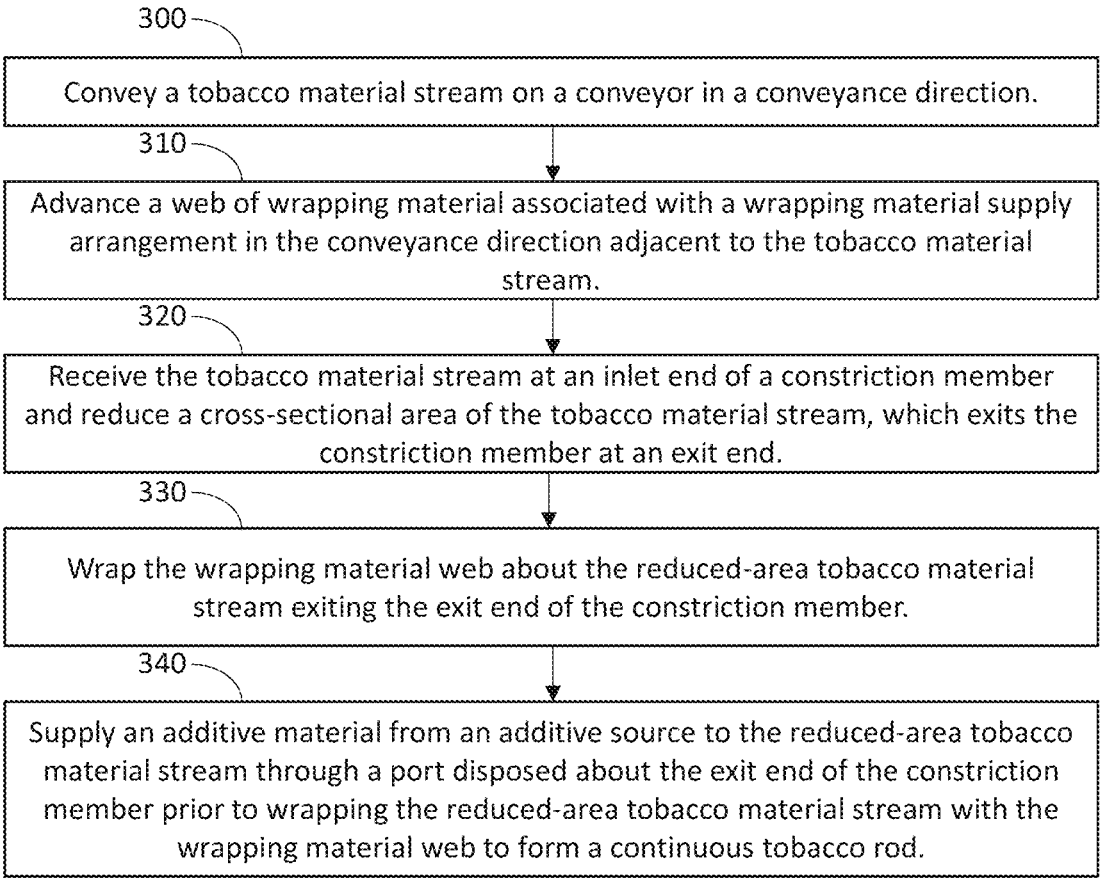

Having thus described the disclosure in general terms, reference will now be made to the accompanying drawings, which are not necessarily drawn to scale, and wherein:

FIG. 1 schematically illustrates an apparatus arranged to form a tobacco rod of a smoking article, according to one aspect of the present disclosure;

FIGS. 2 and 3 schematically illustrate a constriction member of the apparatus arranged to form the tobacco rod of the smoking article, according to the aspect of the present disclosure shown in FIG. 1;

FIG. 4 schematically illustrates a garniture section of the apparatus arranged to form the tobacco rod of the smoking article, according to the aspect of the present disclosure shown in FIG. 1; and FIG. 5 schematically illustrates a method of forming a tobacco rod of a smoking article, according to one aspect of the present disclosure.

DETAILED DESCRIPTION OF THE DISCLOSURE

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will satisfy applicable legal requirements. Like numbers refer to like elements throughout.

Aspects of the present disclosure, as shown, for example, in FIG. 1, are directed to an apparatus 10 arranged to form a tobacco rod of a smoking article. In particular aspects, such an apparatus 10 is particularly arranged to apply an additive such as, for example, a flavorant, to the tobacco material of the tobacco rod during the tobacco rod formation process. In further particular aspects, the additive is a normally-crystalline material, such as menthol, and the application of the additive occurs, for example, in the garniture region 40 of the apparatus 10 in the tobacco rod formation process.

A cigarette rod making machine useful in carrying out such a tobacco rod formation process is of the type commercially available from Molins PLC or Hauni-Werke Korber & Co. KG, and the use thereof is well known to the person of ordinary skill in the art. For example, a preferred cigarette rod making machine of the type known as PROTOS (commercially available from Hauni-Werke Korber & Co. KG) can be employed and directly coupled with a filter tipping machine such as a MAX 80 (commercially available from Hauni-Werke & Korber & Co. KG). A description of a PROTOS cigarette making machine is provided, for example, in U.S. Pat. No. 4,474,190 to Brand at col. 5, line 48 through col. 8, line 3, which is incorporated herein by reference. Other cigarette rod making machines, such as the PROTOS 100 (manufactured by Hauni-Werke Korber & Co., KG) and the Molins MK 10N (manufactured by Molins PLC), can be employed.

In some aspects, as shown for example in FIG. 1, the apparatus (otherwise referred to herein as a "cigarette making machine") 10 includes a tobacco source, such as a chimney 15, through which a tobacco filler 20 or other smoking material or tobacco material is established in a continuous smoking material/tobacco stream 25 on and to be conveyed by an endless, porous, formable conveyor belt 30 in a conveyance direction 350. The smoking material/tobacco stream 25 is maintained on the conveyor belt 30, for example, by a suction source 28 disposed within the loop of the conveyor belt 30. As such, a source of tobacco filler material is established and maintained in order that a continuous stream of tobacco filler is supplied. The stream 25 of tobacco filler 20 is conveyed by the belt 30 past a trimming or equalizing device 35 in order to make the stream 25 more uniform and therefore supply a uniform stream 25 of the tobacco filler 20.

The cigarette making machine 10 also includes a garniture section 40, which further includes an endless formable garniture conveyor belt 45. The garniture conveyor belt 45 advances a continuous web 50 of wrapping material, such as cigarette paper, supplied from a bobbin 52 (otherwise referred to herein as "a wrapping material supply arrangement"). The garniture conveyor belt 45 is arranged to advance the web of wrapping material 50 in the conveyance direction 350 adjacent to the tobacco material stream 25. One end of the garniture conveyor belt 45 is positioned adjacent to and below the exit end of the porous belt 30 and arranged such that the tobacco stream 25 leaving the porous belt 30 is deposited on the wrapping material/web 50.

A short tongue 54 located above the garniture conveyor belt 45 begins to constrict the stream 25 of tobacco filler 20 as the garniture conveyor belt 45 begins to form the tobacco filler stream 25 and wrapping material/web 50 into a continuous tobacco rod. A primary tongue 60 (otherwise referred to herein as "a constriction member"), is located above the garniture conveyor belt 45 in the garniture section 40, following and downstream of the short tongue 54 in the conveyance direction 350, and is arranged to continue constricting the tobacco filler stream 25 as the garniture conveyor belt 45 forms the tobacco filler 20 and wrapping material/web 50 into a continuous tobacco rod. The primary tongue 60 includes a filler-contacting surface 85 (see, e.g., FIG. 3) having a semi-cylindrical configuration (e.g., a longitudinally-sectioned funnel), wherein an inlet end 200 has a larger radius than an exit end 210 of the filler-contacting surface 85 (see, e.g., FIG. 3). As such, the primary tongue 60 is arranged to receive the tobacco material stream 25 at the inlet end 200, in cooperation with the garniture conveyor belt 45 to maintain the continuous stream 25 of tobacco filler 20 therebetween. The filler-contacting surface 85 (see, e.g., FIG. 3) of the primary tongue 60 thus cooperates with the garniture conveyor belt 45 to reduce a cross-sectional area of the tobacco material stream 25 (e.g., the dimension of the tobacco material stream perpendicular to the direction of travel), as the tobacco material stream 25 proceeds toward the exit end 210 of the primary tongue 60. The reduced-area tobacco material stream 25 then exits the primary tongue 60 at the exit end 210 of the filler-contacting surface 85 (see, e.g., FIG. 3).

The primary tongue 60 extends to a point (e.g., the exit end 210) where the wrapping material/web 50 is secured around the tobacco material/filler stream 25. The primary tongue 60 and the garniture conveyor belt 45 carrying the wrapping material/web 50 cooperate to define a passage which progressively decreases in cross-section (e.g., dimension perpendicular to the direction of travel) in the direction of movement of the tobacco filler stream 25 such that the tobacco filler stream 25 progressively assumes a substantially circular cross-section of decreasing diameter. As such, the tobacco filler stream 25 is formed into substantially the desired cross-section (e.g., a constant diameter, continuous cylindrical rod) of a finished cigarette tobacco rod 80. That is, the wrapping material/web 50 transported by the garniture conveyor belt 45 is arranged to be wrapped about the reduced-area tobacco material (filler) stream 25 exiting the exit end 210 of the primary tongue 60. A formed tobacco rod (tobacco filler material wrapped by the wrapping material/web) thus exits the primary tongue 60, where an adhesive is applied to an exposed length or overlap region of the wrapping material/web 50 using an adhesive applicator 70. The exposed length of the wrapping material/web 50 is then overlapped onto itself (longitudinally along the continuous tobacco rod), and the adhesive is set in by a curing device 75 (e.g., a heater) in order to secure the continuous wrapping material/web 50 around the continuous stream 25 of the tobacco material filler 20, thereby forming a continuous cigarette tobacco rod 80.

The rate at which the continuous tobacco rod 80 is manufactured is essentially equal to the rate at which the stream 25 of tobacco material filler 20 is established and supplied. The continuous tobacco rod 80 can subsequently be subdivided into a plurality of rod portions, each rod portion being of the desired length, using known techniques. Although the circumference of cigarette tobacco rods can vary, typical tobacco rod circumferences range from about 19 mm to about 27 mm, and more typically from about 22 mm to about 25 mm.

As shown in FIGS. 2 and 3, the primary tongue 60 is manufactured, for example, from bronze, carbon steel, stainless steel, or the like. The primary tongue 60 has a filler-contacting surface 85 (shown in FIG. 3) that has a shape (e.g., a semi-cylindrical or concave configuration with a progressively decreasing radius) which forms the tobacco filler stream 25 which comes into contact therewith into a rod-like member having the desired cross-sectional shape (e.g., cylindrical with constant diameter cross-section). For typical cigarette tobacco rods 80 having a generally circular cross section, the filler-contacting surface 85 of the primary tongue 60 typically has a generally semi-cylindrical configuration. The filler-contacting surface 85 of the primary tongue 60 can be surface-treated or coated, if desired. For example, the filler-contacting surface 80 can be surface-treated or coated with a ceramic material or other suitable material having a low coefficient of friction. Alternatively, the filler-contacting surface 85 of the primary tongue 60 can be manufactured from a porous material, such as a sintered metal. In other instances, the filler-contacting surface 85 of the primary tongue 60 can be the same material from which the primary tongue 60 is formed (e.g., not surface treated, coated and/or formed of a different material than the primary tongue 60).

In particular aspects of the present disclosure, a liquid/fluid additive can be fed into the primary tongue 60, and the primary tongue 60 arranged such that the liquid additive exits the filler-contacting surface 85 through one or more bores or dispensing ports 95 extending through the surface treatment, coating, or other material disposed on or otherwise forming the filler-contacting surface 85. Furthermore, in some instances, a primary tongue 60 having or defining suitable bores or dispensing ports 95 (otherwise referred to herein as "liquid outlet openings") can have the filler-contacting surface 85 thereof treated with a porous material, wherein the liquid additive is dispensed so as to flow through the porous material, if present, to the portion of the filler-contacting surface 85 contacting the stream 25 of the tobacco filler material 20. In further particular aspects of the disclosure, an additive source 110 (e.g., a reservoir tank) is arranged to supply an additive material 112 (e.g., a flavorant such as menthol) to the reduced-area tobacco material stream 25, through the one or more dispensing ports 95 defined by and disposed about or in proximity to the exit end 210 filler-contacting surface 85 of the primary tongue 60, prior to (in some instances, immediately prior to) the reduced-area tobacco material stream 25 being wrapped by the wrapping material/web 50 to form the continuous tobacco rod 80.

As shown, for example, in FIGS. 2 and 3, the primary tongue 60 can be implemented such that the additive material 112 (e.g., in a liquid/fluid form) is introduced into the primary tongue 60 through a vertical bore or passageway 90, and flows through the passageway 90 to the one or more liquid outlet openings 95 in the filler-contacting surface 85. It is preferable that the liquid outlet openings 95 be positioned about, towards, or proximate to the exit end 210 of the filler-contacting surface 85 of the primary tongue 60, which last contacts the tobacco filler stream 25 (i.e., the downstream end 210 of the primary tongue 60). The liquid outlet openings 95 in the filler-contacting surface 85 of the primary tongue 60 can vary in number, shape and positioning. For example, the liquid outlet openings 95 can be a single opening about, toward, or in proximity to the downstream end 210 of the primary tongue 60, or the liquid outlet openings 95 can be a plurality of outlet openings positioned longitudinally along the filler-contacting surface 85 toward the downstream end 210 of the primary tongue 60. The liquid outlet openings 95 can be defined by the primary tongue 60 itself, or may comprise, for example, one or more nozzles (not shown) installed in the primary tongue 60 and exiting through the liquid outlet opening(s) 95.

Although the total number of liquid outlet openings 95 can vary, it is preferable to employ less than 10 outlet openings. The cross-sectional shape of the liquid outlet openings 95 can be circular, oval, or the like. For example, liquid outlet openings 95 having a circular cross-sectional shape often can have diameters which range from about 0.25 mm to about 1.5 mm. The liquid outlet openings 95 most desirably are positioned at an angle of less than 90° relative to the filler-contacting surface 85 (e.g., inclined in the downstream direction), as shown for example, in FIG. 2, so as to minimize the possibility of clogging the liquid outlet openings 95 by particles of the tobacco filler 20 from the moving tobacco filler material stream 25 entering the liquid outlet opening(s) 95. It also is possible to employ grooves or channels which extend generally along the longitudinal and/or lateral direction of the filler-contacting surface 85 of the primary tongue 60 from each liquid outlet opening 95 in order to promote a dispersion of the liquid additive 112 across the entire filler-contacting surface 85 of the primary tongue 60. In particular aspects, the liquid outlet openings 95 are positioned within the downstream half, more particularly the downstream third, of the longitudinal length of the filler-contacting surface 85 of the primary tongue 60, so as to be about, toward, or adjacent to the exit end 210 of the primary tongue 60. In other aspects, multiple liquid outlet openings 95 can be arranged in different patterns such as, for example, in even parallel rows, in staggered rows, in a circular arrangement, or in any other arrangement that promotes even distribution of the additive material 112 onto the tobacco filler 20 in the tobacco material stream 25 engaging the primary tongue 60.

In some aspects, the primary tongue 60 has a first heating element 220 integrated therein or otherwise engaged therewith for heating the primary tongue 60 toward the exit end 210 thereof. That is, in some aspects, a first heating element 220 is arranged to communicate heat to the exit end 210 of the primary tongue 60, particularly about and along the vertical bore or passageway 90 leading to the one or more dispensing ports 95. In instances wherein the additive 112 is normally in crystalline form at or about room temperature (e.g., menthol), the first heating element 220 is necessary to maintain the additive 112 in liquid form until it is dispensed through the liquid outlet opening(s) 95.

As shown, for example, in FIGS. 1 and 4, the primary tongue 60 is supported and maintained in place in the garniture region 40 of the cigarette making machine 10 using a cantilever beam member 100. A reservoir tank 110 (otherwise referred to herein as "an additive source") for the additive material 112 (e.g., the liquid/fluid being a flavorant such as menthol) is used to provide for a flow of the additive material 112 to the primary tongue 60, for example, via a series of tubes 120 and using a pumping mechanism 130. The pumping mechanism 130 provides positive pressure and/or a positive flow of the additive material 112, in liquid form, through the primary tongue 60 in the desired amount to be dispensed into engagement with the tobacco filler stream 25 during the cigarette/tobacco rod formation process. That is, in some aspects, the pumping mechanism 130 is in fluid communication with the reservoir tank 110 or the tubing/piping 120, and the pumping mechanism 130 is arranged to pump the additive material 112 through the conduit (e.g., tubing/piping 120) and the passageway 90 in the primary tongue 60 to the one or more dispensing ports 95 about, toward, or proximate to the exit end 210 of the primary tongue 60.

In one particular aspect, the pumping mechanism 130 comprises a low volume, positive displacement piston pump. The pumping mechanism 130 timed to the drive shaft (not shown) of the cigarette/tobacco rod making machine using, for example, a timing belt mechanism 150 and pulley 155, is arranged such that a desired amount of the additive material 112 in liquid form flows through the primary tongue 60 at a particular cigarette rod formation speed of the cigarette/tobacco rod making machine 10. The pumping mechanism 130, in some aspects, is arranged to deliver a consistent amount of liquid for passage through the one or more dispensing ports 95 of the primary tongue 60.

In further aspects, a three-way valve 170, a quick disconnector member 175 and a filter element 180 can be implemented. The three-way valve 170 can be of the type commercially available as No X53LB1100 from Skinner Valve Div. of Honeywell, Inc., and provides for a recyclization of the liquid additive material 112 pumped from the reservoir tank 110 by the pumping mechanism 130 prior to the time that the continuous tobacco rod 80 is manufactured by the cigarette/tobacco rod making machine 10 at a speed sufficient to require the introduction of the liquid additive material 112 through the primary tongue 60 (i.e., the liquid additive material 112 is maintained in a ready state until the cigarette/tobacco rod production conditions require the dispensation of the liquid additive material 112, as disclosed herein). The use of the three-way valve 170 may be particularly beneficial, for example, during start-up and shutdown periods of the cigarette/tobacco rod making machine 10. The quick disconnect member 175 is, for example, a combination of part numbers MCD 10-02 and MCD 20-04 from Genoa Corp., and is implemented for convenient servicing of the cigarette/tobacco rod-making machine 10. The filter element 180 can be, for example, a 15 micron filter such as is available as SS-4FW-15 from Nupro Co. The filter element 180 can act to prevent blockage of the passageways 90 which extend through the primary tongue 60 as well as dampen any surges or pulses in the liquid additive flow which passes to the primary tongue 60.

Collectively, in some aspects, the reservoir tank 110, pumping mechanism 130, and associated tubes/piping 120 are part of an additive applicator assembly 250 (otherwise referred to herein as "an additive material dispensing system") such as, for example, the UFA1000 flavor applicator manufactured by CB Kaymich & Co. Limited, which can be implemented to apply many types of cold or heated flavors, such as menthol (crystal or solution), mint, fruit, clove, vanilla, liqueurs, etc. In particular aspects, the additive material 112 of the present disclosure is a flavorant. In still further aspects, the flavorant is menthol. That is, in some aspects, the additive source (e.g., reservoir tank 110) is a menthol source and the additive material 112 is menthol. Menthol is available in solid granular or crystalline form, and becomes a liquid/fluid upon heating. Accordingly, in aspects of the present disclosure, the components of the additive applicator assembly 250 are arranged, as appropriate, to include a heating element/heating device 280 for transforming the solid granular and/or crystalline flavorant such as menthol into a liquid/fluid form for delivery to the tobacco filler stream 25 via the primary tongue 60. For example, any or all of the reservoir tank 110, the pumping mechanism 130, the tubing/piping 120, the three-way valve 170, the quick disconnector member 175, the filter element 180, and the vertical passageway 90 can have a second heating element 280 or other heating arrangement (see, e.g., FIG. 4) associated therewith such that the solid granular and/or crystalline menthol, once transformed into a liquid/fluid, is maintained in that state or form while being transported to the primary tongue 60. In some aspects, the reservoir tank 110 is in fluid communication with the one or more dispensing ports 95 in the filler-contacting surface 85 of the primary tongue 60 via a conduit (e.g., tubing/piping 120) engaged therebetween, and wherein a second heating element 280 is arranged to communicate heat to the reservoir tank 110, to the conduit (tubing/piping 120), and/or to the other components of the additive applicator assembly 250.

In particular instances, a heating element associated with the primary tongue 60 may be present in cigarette/tobacco rod making machines not implementing the additive applicator assembly 250 disclosed herein. That is, in some conventional cigarette/tobacco rod making machines, the primary tongue 60 is heated (e.g., includes a heating element associated therewith that heats at least the filler-contacting surface 85). As such, in some aspects, an additive applicator assembly 250 can be implemented in such cigarette/tobacco rod making machines by substituting the primary tongue 60 with a primary tongue 60 configured according to aspects of the present application (e.g., including the first heating element 220 operably engaged about the exit end 210 and heating the primary tongue 60 about the one or more dispensing ports 95), and engaging the additive applicator assembly 250 therewith. Accordingly, another aspect of the present disclosure comprises an additive material dispensing system for an apparatus arranged to form a tobacco rod of a smoking article (see, e.g., FIGS. 1-4), wherein the apparatus includes a garniture conveyor belt 45 arranged to convey a stream 25 of tobacco material 20 in a conveyance direction 350 and a wrapping material supply arrangement 52 arranged to advance a web of wrapping material 50 in the conveyance direction 350 adjacent to the tobacco material stream 25. Such an additive material dispensing system comprises a constriction member 60 arranged to receive the tobacco material stream 25 at an inlet end 200 and to reduce a cross-sectional area of the tobacco material stream 25, with the reduced-area tobacco material stream 25 exiting the constriction member 60 at an exit end 210, and wherein the constriction member 60 is further arranged such that the wrapping material web 50 is wrapped about the reduced-area tobacco material stream 25 exiting the exit end 210. In addition, an additive source 110 is arranged to supply an additive material 112 to the reduced-area tobacco material stream 25 through a dispensing port 95 disposed about the exit end 210 of the constriction member 210, prior to the reduced-area tobacco material stream 25 being wrapped by the wrapping material web 50 to form a continuous tobacco rod 80.

In other aspects, the primary tongue 60 that is particularly adapted and arranged to dispense a flavorant (additive material 112) to the tobacco filler stream 25 from an additive applicator assembly 250, as disclosed herein, can be implemented in a conventional cigarette/tobacco making machine that does not dispense a flavorant (additive material) by directing the additive applicator assembly 250 to refrain from dispensing any additive material 112 during the cigarette/tobacco rod formation process.

Yet another associated aspect of the resent disclosure includes a method of forming a tobacco rod of a smoking article as shown, for example, in FIG. 5, in such an aspect, the method comprises conveying a stream of tobacco material on a conveyor in a conveyance direction (Block 300), and advancing a web of wrapping material associated with a wrapping material supply arrangement in the conveyance direction adjacent to the tobacco material stream (Block 310). The tobacco material stream is received at an inlet end of a constriction member and a cross-sectional area of the tobacco material stream is reduced (Block 320). The reduced-area tobacco material stream exits the constriction member at an exit end thereof, and the wrapping material web wrapped about the reduced-area tobacco material stream exiting the exit end of the constriction member (Block 330). An additive material is dispensed from an additive source to the reduced-area tobacco material stream through a dispensing port disposed about the exit end of the constriction member prior to wrapping the reduced-area tobacco material stream with the wrapping material web to form a continuous tobacco rod (Block 340).

The wrapping material/web 50 implemented in aspects herein can vary, and most conveniently is a cigarette paper wrap of the type commonly used for cigarette rod manufacture. Examples of suitable paper wrapping materials are manufactured from flax fiber and calcium carbonate filler, and are commercially available as Reference Nos. 719 and 856 from Kimberly-Clark Corp. Also useful are those paper wrapping materials available as Ecusta Experimental Nos. TOD 01788, TOD 03363 and TOD 03732 from Ecusta Corp. Such paper wrapping materials generally are provided as a web wrapped on a bobbin.

The smokable filler employed for the manufacture of the cigarette rod can vary. The smokable filler is generally employed in a cut filler form, which is blended, cased, and cut filler ready for cigarette manufacture. Smokable filler can be tobacco material, as well as tobacco substitute materials such as carbonized or pyrolyzed materials, organic and inorganic filler materials, and the like. As such, cut filler can be strands or shreds of tobacco laminae, processed stems or reconstituted tobacco, which can have widths ranging from about 1/25 inch to about 1/60 inch, preferably from about 1/30 inch to about 1/40 inch.

The process/method disclosed herein allows the person of ordinary skill in the art to efficiently and effectively manufacture cigarette rods using smokable filler blends having high filling capacities. By "filling capacity" is meant the ability of filler at a particular moisture content to form a firm cigarette rod. See, Tobacco Encyclopedia, edit. by E. Voges, T J I (1984), pp. 457-459. As such, filler materials having high filling capacities require a relatively low weight of filler to produce a cigarette rod. For purposes of this disclosure, the filling capacity of a particular smokable filler material is determined by charging the filler of a known weight into a tube having a height of about 200 mm and an inner diameter of about 96 mm. Typically, enough filler is employed to fill the tube about 3/4 full. A piston having a height of about 170 mm and an outer diameter of about 93.5 mm includes a support housing such that the piston and housing weighs about 26 pounds. The piston is lowered onto the filler and is allowed to rest on the filler. After the piston and housing rests on the filler for 5 seconds, the volume occupied by the filler within the cylinder is recorded. Typical high filling capacities for purposes of this disclosure are greater than about 500, frequently greater than 550, often greater than 600, and sometimes greater than 650. Such filling capacity values are reported in units of milliliters per 2.3 psi per 100 g of filler at 12 weight percent moisture at 76° F. (24.4° C.) as determined using the previously described procedure. Generally, blends having such high filling capacities are employed, for purposes of this disclosure, at a moisture content of about 12 weight percent to about 14 weight percent, more often about 13 weight percent (i.e., at the moisture content at which cut filler conventionally is employed in the manufacture of cigarette rods).

Typical high filling capacity blends include a relatively high proportion of volume expanded filler as the filler material used to manufacture the cigarette rods. For example, at least about 40 weight percent, frequently at least about 50 weight percent, often at least about 60 weight percent, and even at least about 70 weight percent of the filler material is volume expanded filler material. As used herein, "volume expanded filler material" is used to refer to a smokable material which has a specific gravity less than hexane. Volume expanded filler materials can be volume expanded tobacco cut filler, volume expanded cut tobacco stems, volume expanded tobacco substitutes such as puffed grains, and the like. Methods for providing volume expanded smokable filler materials are well known to the person of ordinary skill in the art. In particular, smokable filler materials generally are impregnated with an expansion agent such as carbon dioxide, halocarbons, propane, ammonium carbonate, water, or the like; and the expansion agent is rapidly vented to expand the cell structure of the smokable material. Typically, volume expanded smokable materials exhibit volume increase of about 50 percent to about 250 percent, more frequently about 60 percent to about 120 percent, relative to the volume of the smokable material prior to volume expansion treatment.

The volume expanded filler material and the other smokable filler materials of the smokable blend are blended using known techniques. However, if desired, essentially all of the smokable material used to manufacture cigarette rods according to this disclosure can be volume expanded filler material. In addition, in most instances, essentially all of the smokable filler material used to manufacture cigarette rods according to this disclosure is tobacco material.

Many modifications and other embodiments of the inventions set forth herein will come to mind to one skilled in the art to which these disclosed embodiments pertain having the benefit of the teachings presented in the foregoing descriptions and the associated drawings. Therefore, it is to be understood that embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure. In this regard, for example, different combinations of elements and/or functions than those explicitly described above are also contemplated within the scope of the disclosure. Although specific terms are employed herein, they are used in a generic and descriptive sense only and not for purposes of limitation.

It should be understood that although the terms first, second, etc. may be used herein to describe various steps or calculations, these steps or calculations should not be limited by these terms. These terms are only used to distinguish one operation or calculation from another. For example, a first calculation may be termed a second calculation, and, similarly, a second step may be termed a first step, without departing from the scope of this disclosure. As used herein, the term "and/or" and the "/" symbol includes any and all combinations of one or more of the associated listed items.

As used herein, the singular forms "a", "an" and "the" are intended to include the plural forms as well, unless the context clearly indicates otherwise. It will be further understood that the terms "comprises", "comprising", "includes", and/or "including", when used herein, specify the presence of stated features, integers, steps, operations, elements, and/or components, but do not preclude the presence or addition of one or more other features, integers, steps, operations, elements, components, and/or groups thereof.

Therefore, the terminology used herein is for the purpose of describing particular embodiments only and is not intended to be limiting.

That which is claimed:

1. An apparatus arranged to form a continuous tobacco rod of a smoking article, comprising:

a conveyor arranged to convey a tobacco material stream in a conveyance direction;

a wrapping material supply arrangement arranged to advance a web of wrapping material in the conveyance direction adjacent to the tobacco material stream;

a constriction member arranged to receive the tobacco material stream at an inlet end and to reduce a cross-sectional area of the tobacco material stream, the reduced-area tobacco material stream exiting the constriction member at an exit end, and the wrapping material web being arranged to wrap about the reduced-area tobacco material stream exiting the exit end;

a first heating element arranged with respect to the constriction member to communicate heat to the exit end of the constriction member; and an additive source arranged to supply an additive material to the reduced-area tobacco material stream through a dispensing port disposed about the exit end of the constriction member prior to the reduced-area tobacco material stream being wrapped by the wrapping material web to form the continuous tobacco rod.

2. The apparatus of claim 1, wherein the additive source is a menthol source and the additive material is menthol.

3. The apparatus of claim 1, wherein the additive source is in fluid communication with the dispensing port via a conduit engaged therebetween, and wherein the apparatus further comprises a second heating element arranged to communicate heat to the additive source or to the conduit.

4. The apparatus of claim 3, comprising a pump in fluid communication with the additive source or the conduit, and arranged to pump the additive material through the conduit to the dispensing port.

5. An additive material dispensing system for an apparatus arranged to form a continuous tobacco rod of a smoking article, the apparatus including a conveyor arranged to convey a tobacco material stream in a conveyance direction and a wrapping material supply arrangement arranged to advance a web of wrapping material in the conveyance direction adjacent to the tobacco material stream, the additive material dispensing system comprising:

a constriction member arranged to receive the tobacco material stream at an inlet end and to reduce a cross-sectional area of the tobacco material stream, the reduced-area tobacco material stream exiting the constriction member at an exit end, and the constriction member being further arranged such that the wrapping material web wraps about the reduced-area tobacco material stream exiting the exit end;

a first heating element arranged with respect to the constriction member to communicate heat to the exit end of the constriction member; and an additive source arranged to supply an additive material to the reduced-area tobacco material stream through a dispensing port disposed about the exit end of the constriction member, prior to the reduced-area tobacco material stream being wrapped by the wrapping material web to form the continuous tobacco rod.

6. The system of claim 5, wherein the additive source is a menthol source and the additive material is menthol.

7. The system of claim 5, wherein the additive source is in fluid communication with the dispensing port via a conduit engaged therebetween, and wherein the system further comprises a second heating element arranged to communicate heat to the additive source or to the conduit.

8. The system of claim 7, comprising a pump in fluid communication with the additive source or the conduit, and arranged to pump the additive material through the conduit to the dispensing port.

9. A method of forming a continuous tobacco rod of a smoking article, comprising:

conveying a tobacco material stream on a conveyor in a conveyance direction;

advancing a web of wrapping material associated with a wrapping material supply arrangement in the conveyance direction adjacent to the tobacco material stream;

receiving the tobacco material stream at an inlet end of a constriction member and reducing a cross-sectional area of the tobacco material stream, the reduced-area tobacco material stream exiting the constriction member at an exit end;

wrapping the wrapping material web about the reduced-area tobacco material stream exiting the exit end of the constriction member;

communicating heat from a first heating element, arranged with respect to the constriction member, to the exit end of the constriction member; and supplying an additive material from an additive source to the reduced-area tobacco material stream through a dispensing port disposed about the exit end of the constriction member prior to wrapping the reduced-area tobacco material stream with the wrapping material web to form the continuous tobacco rod.

10. The method of claim 9, wherein supplying the additive material from the additive source to the reduced-area tobacco material stream through the dispensing port comprises supplying menthol from a menthol source to the reduced-area tobacco material stream through the dispensing port.

11. The method of claim 9, wherein the additive source is in fluid communication with the dispensing port via a conduit engaged therebetween, and wherein the method further comprises communicating heat from a second heating element to the additive source or to the conduit.

12. The method of claim 11, comprising pumping the additive material through the conduit and to the dispensing port with a pump in fluid communication with the additive source or the conduit.

13. An apparatus arranged to form a continuous tobacco rod of a smoking article, comprising:

a conveyor arranged to convey a tobacco material stream in a conveyance direction;

a wrapping material supply arrangement arranged to advance a web of wrapping material in the conveyance direction adjacent to the tobacco material stream;

a tongue arranged to receive the tobacco material stream at an inlet end and to reduce a cross-sectional area of the tobacco material stream, the reduced-area tobacco material stream exiting the tongue at an exit end, and the wrapping material web being arranged to wrap about the reduced-area tobacco material stream exiting the exit end, the tongue having a first heating element arranged to communicate heat to the exit end of the constriction member; and an additive source arranged to transform a crystalline additive into a liquid additive and to supply the liquid additive to the reduced-area tobacco material stream through a dispensing port disposed about the heated exit end of the tongue prior to the reduced-area tobacco material stream being wrapped by the wrapping material web to form the continuous tobacco rod.

14. The apparatus of claim 13, wherein the additive source is a menthol source and the crystalline additive is menthol.

15. The apparatus of claim 13, wherein the additive source is in fluid communication with the dispensing port via a conduit engaged therebetween, and wherein the apparatus further comprises a second heating element arranged to communicate heat to the additive source or to the conduit.

16. The apparatus of claim 15, comprising a pump in fluid communication with the additive source or the conduit, and arranged to pump the additive material through the conduit to the dispensing port.

* * * * *